US010851683B2

(12) United States Patent
Breuer et al.

(10) Patent No.: US 10,851,683 B2
(45) Date of Patent: Dec. 1, 2020

(54) MECHANICALLY CONTROLLABLE VALVE DRIVE

(71) Applicant: PIERBURG GMBH, Neuss (DE)

(72) Inventors: Michael Breuer, Simmerath (DE); Karsten Grimm, Aachen (DE); Stephan Schmitt, Willich (DE); Sabine Siebrandt, Viersen (DE)

(73) Assignee: PIERBURG GMBH, Neuss (DE)

( * ) Notice: Subject to any disclaimer, the term of this patent is extended or adjusted under 35 U.S.C. 154(b) by 977 days.

(21) Appl. No.: 15/320,753

(22) PCT Filed: Apr. 30, 2015

(86) PCT No.: PCT/EP2015/059524
§ 371 (c)(1),
(2) Date: Dec. 21, 2016

(87) PCT Pub. No.: WO2016/005071
PCT Pub. Date: Jan. 14, 2016

(65) Prior Publication Data

US 2017/0198614 A1 Jul. 13, 2017

(30) Foreign Application Priority Data

Jul. 9, 2014 (DE) ..... 10 2014 109 573

(51) Int. Cl.
*F01L 13/00* (2006.01)
*F01L 1/047* (2006.01)
*F01L 1/18* (2006.01)

(52) U.S. Cl.
CPC ..... *F01L 13/0063* (2013.01); *F01L 1/047* (2013.01); *F01L 1/18* (2013.01); *F01L 1/185* (2013.01);
(Continued)

(58) Field of Classification Search
CPC ..... F01L 13/0005; F01L 13/0063; F01L 13/0021; F01L 13/0026; F01L 13/0036; F01L 1/047; F01L 1/18; F01L 1/185
(Continued)

(56) References Cited

U.S. PATENT DOCUMENTS

2004/0144347 A1 7/2004 Schleusener et al.
2007/0022990 A1* 2/2007 Werler ..... F01L 1/185 123/90.16

FOREIGN PATENT DOCUMENTS

DE 101 23 186 A1 11/2002
DE 102 26 300 A1 1/2004
(Continued)

*Primary Examiner* — Jorge L Leon, Jr.
*Assistant Examiner* — Loren C Edwards
(74) *Attorney, Agent, or Firm* — Norman B. Thot

(57) ABSTRACT

A valve drive includes a transfer arrangement with an intermediate lever arrangement having a first roller element and an intermediate lever, and a drag lever arrangement having a drag lever. The first roller element is connected to a circumferential contour of a camshaft. The intermediate lever includes a second roller element and a working curve connected to the drag lever. A slotted guide is provided for the intermediate lever arrangement which is engaged by a guide roller element. A torsion spring element with first and second ends engages the intermediate lever arrangement. The first end rests on the cylinder housing portion. The second end acts on a counter bearing rigidly connected with the intermediate lever. The first and second roller element axes are arranged to introduce a force into the intermediate lever which presses the guide roller element against the slotted guide and the first roller element against the camshaft.

2 Claims, 4 Drawing Sheets

(52) U.S. Cl.
CPC ... *F01L 2013/0068* (2013.01); *F01L 2305/00* (2020.05)

(58) Field of Classification Search
USPC ..... 123/90.45
See application file for complete search history.

(56) References Cited

FOREIGN PATENT DOCUMENTS

| | | | |
|---|---|---|---|
| DE | 103 20 324 | A1 | 7/2004 |
| DE | 10 2004 003 327 | A1 | 9/2005 |
| DE | 10 2004 040 652 | A1 | 2/2006 |
| DE | 10 2004 049 538 | A1 | 4/2006 |
| DE | 10 2010 009 399 | A1 | 9/2011 |
| DE | 10 2012 006 982 | A1 | 10/2013 |
| EP | 1 387 048 | A2 | 2/2004 |
| EP | 1 387 049 | A1 | 2/2004 |
| JP | 2007-77939 | A | 3/2007 |

* cited by examiner

MECHANICALLY CONTROLLABLE VALVE DRIVE

CROSS REFERENCE TO PRIOR APPLICATIONS

This application is a U.S. National Phase application under 35 U.S.C. § 371 of International Application No. PCT/EP2015/059524, filed on Apr. 30, 2015 and which claims benefit to German Patent Application No. 10 2014 109 573.1, filed on Jul. 9, 2014. The International Application was published in German on Jan. 14, 2016 as WO 2016/005071 A1 under PCT Article 21(2).

FIELD

The present invention relates to a mechanically controllable valve drive comprising a gas exchange valve, wherein a transfer arrangement is paired with the gas exchange valve, and wherein the transfer arrangement has an intermediate lever arrangement and a drag lever arrangement, wherein an intermediate lever of the intermediate lever arrangement has a working curve for an operative connection to a drag lever of the drag lever arrangement, wherein the intermediate lever has a first roller element which is operatively connected to a circumferential contour of a camshaft, and wherein the intermediate lever has a second roller element which is rotatably mounted on an axis so that the second roller element is operatively connected to a valve stroke adjusting device so that different valve stroke positions can be set, wherein a spring is provided which engages the intermediate lever arrangement, a guiding device is provided for the intermediate lever arrangement, wherein the guiding device consists of a slotted guide which is engaged by at least one guide roller element that is provided in the region of the second roller element, wherein the working curve of the intermediate lever is essentially formed by two partial regions, i.e., a first partial region formed as a circular path about the center of the axis of the second roller element, and a second partial region formed as a continuous lobe curve, wherein the spring is formed by a torsion spring element, the first end of which rests on a cylinder housing portion and the second end of which acts on a counter bearing rigidly connected with the intermediate lever.

BACKGROUND

Such mechanically controllable valve drives are generally known. For example, DE 10 2012 006 982 A1 describes a mechanically controllable valve drive in which, in the region of the first roller element that cooperates with the camshaft, at least one further roller element is provided which causes the intermediate lever to be guided in a slotted guide. However, this only effects an indirect force dissipation of the gas exchange valve forces in the direction of the valve axis, which may result in deformation and losses in rigidity of the axis on which the first roller element and the guide roller element are supported. The immediate vicinity of the rapidly moving guide roller element and the first roller element moreover provides a kinematic disadvantage with respect to friction and lubrication since the first roller element rotates faster than the guide roller element. A separate transfer arrangement for a single gas exchange valve is further possible only with considerable constructive effort. A generic valve drive is described in DE 103 20 324 A1 in which a sliding support is provided as a guiding means that bears on the valve stroke adjustment means. This embodiment also has drawbacks, in particular with respect to the friction and the wear of the valve stroke adjustment means. This embodiment also has a complicated structure. DE 10 2010 009 399 A1, EP 1 387 048 A2 and EP 1 387 049 A1 describe valve drives in which a conveyor roller element is provided in the region of the second roller element, wherein, however, the second roller element is pressed against the slotted guide by the valve stroke adjustment means. These embodiments also have drawbacks with respect to compactness and the number of components.

SUMMARY

An aspect of the present invention is therefore to provide a mechanically controllable valve drive that avoids the above drawbacks.

In an embodiment, the present invention provides a mechanically controllable valve drive which includes a gas exchange valve, a camshaft comprising a circumferential contour, a valve stroke adjusting device, a cylinder housing portion, and a transfer arrangement paired with the gas exchange valve. The transfer arrangement includes an intermediate lever arrangement and a drag lever arrangement. The drag lever arrangement includes a drag lever. The intermediate lever arrangement includes a first roller element and an intermediate lever. The first roller element includes a first roller element axis. The first roller element is configured to be operatively connected to the circumferential contour of the camshaft. The intermediate lever includes a working curve and a second roller element. The working curve is configured to be operatively connected to the drag lever of the drag lever arrangement. The second roller element is rotatably mounted on a second roller element axis so as to be operatively connected to the valve stroke adjusting device so that different valve stroke positions can be set. A spring is configured to engage the intermediate lever arrangement. A counter bearing is rigidly connected with the intermediate lever. At least one guide roller element is arranged in a region of the second roller element. A guide is provided for the intermediate lever arrangement. The guide is a slotted guide which is engaged by the at least one guide roller element. The working curve of the intermediate lever is essentially formed by a first partial region formed as a circular path about a center of the second roller element axis, and a second partial region formed as a continuous lobe curve. The spring is a torsion spring element comprising a first end and a second end. The first end is configured to rest on the cylinder housing portion, and the second end is configured to act on the counter bearing which is rigidly connected with the intermediate lever. The first roller element axis has a distance to the counter bearing which is greater than a distance of the second roller element axis to the counter bearing so that a force is introduced into the intermediate lever which both presses the guide roller element against the slotted guide and the first roller element against the camshaft.

BRIEF DESCRIPTION OF THE DRAWINGS

The present invention is described in greater detail below on the basis of embodiments and of the drawings in which.

DETAILED DESCRIPTION

In an embodiment of the present invention, an axis of the first rolling element can, for example, have a greater distance to the counter bearing than the axis of the second roller element so that a force is introduced into the intermediate lever which both presses the guide roller element against the slotted guide and presses the first roller against the camshaft. This provides a direct dissipation of the valve forces into the slotted guide, thereby significantly reducing the load of the intermediate lever. It is thus possible to design the intermediate lever to be compacter and lighter. Such an arrangement also changes the phase of the valve opening relative to the cam angle and thus to the crank angle. A camshaft actuator for the camshaft can thereby be used that has a reduced adjustment range.

In an embodiment of the present invention, the guide roller element can, for example, be the second roller element. A common stationary contact roller is thereby provided for guiding in the slotted link and for operative connection with the valve stroke adjustment device. A significantly smaller number of components and less constructive effort is thereby possible. Less friction further occurs due to integrally shorter rolling paths under load. The moved mass of the intermediate lever arrangement is at the same time reduced. It is also possible, however, that at least one separate guide roller element is supported on the axis of the second roller element.

In an embodiment of the present invention, the axis of the second roller element can, for example, be rigidly connected with the intermediate lever. In an embodiment of the present invention, an effective contour of the slotted link can, for example, be designed as a circular path around the center of a third roller element of the drag lever in contact with the base circle of the camshaft.

The present invention will be explained in greater detail below under reference to the drawings.

The basic function of a mechanical valve drive described hereunder is generally known by the designation "Uni-Valve". Reference is made to DE 10 2004 003 327 A1 and DE 10 2012 006 982 A1 for the general function of such a valve drive.

Figure 1:
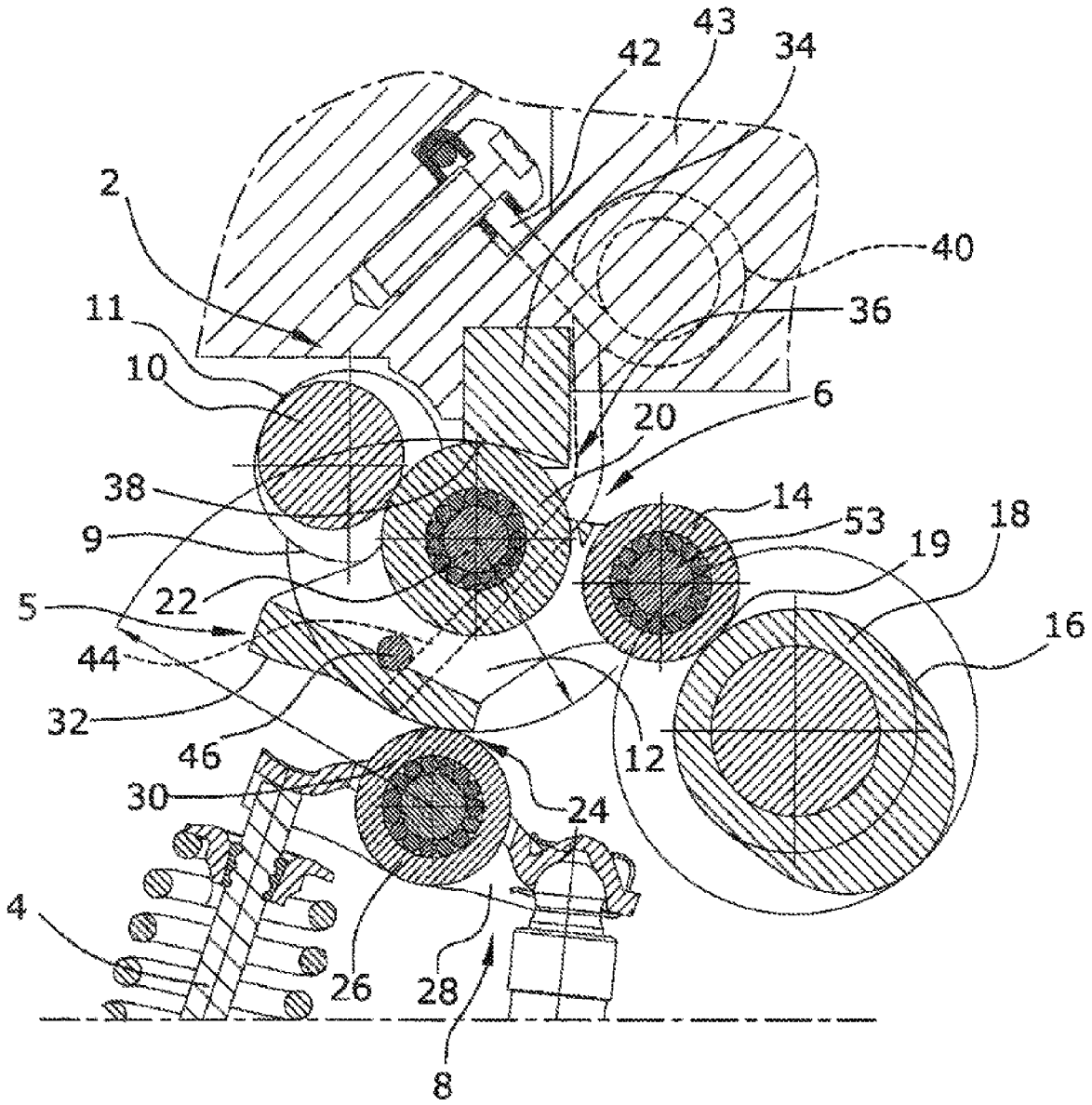
FIG. 1 shows a schematic side view of a mechanically controllable valve drive according to the present invention where the gas exchange valve is in a closed position.

FIG. 1 shows a mechanically controllable valve drive 2 of the present invention for a schematically shown gas exchange valve 4 with a transfer arrangement 5 which, in the shown embodiment, comprises an intermediate lever arrangement 6 and a drag lever arrangement 8. A valve stroke adjustment device 10 is provided in the form of a circumferential contour 9 with an eccentric portion set back with respect to a base circle 11, which is driven by an actuator (not shown in the drawings). The intermediate lever arrangement 6 comprises an intermediate lever 12 with a first roller element 14 in operative connection with a circumferential contour 16 of a camshaft 18. The intermediate lever 12 has a second roller element 20 rotatably supported on an axis 22 and in operative connection with the valve stroke adjustment device 10 so that various valve stroke positions of the gas exchange valve 4 can be adjusted in a manner known per se. For this purpose, the intermediate lever 12 has a working curve 24 which, in a manner known per se, is in operative connection with the third roller element 26 of a drag lever 28 of the drag lever arrangement 8. The working curve 24 of the intermediate lever 12 essentially comprises a first partial region 30 and a second partial region 32. As illustrated, the first partial region 30 is designed as a circular path around the center of the axis 22 of the second roller element 20. The second partial region 32 is designed as a continuous lobe curve.

In order to provide a particularly compact valve drive 2 that is optimal with respect to kinematic relations, the second roller element 20 is designed as a guide roller element in addition to its function as a contact surface for the valve stroke adjustment device 10, the guide roller element, together with a slotted guide 34, serving as a guide 36 for the intermediate lever 12. It should be clear that the guide 36 may also be formed as separate guide roller elements so that, in this case, at least one guide roller element would be arranged on the axis 22 beside the second roller element 20, the guide roller element engaging the slotted guide 34. In the shown embodiment, the axis 22 is rigidly connected with the intermediate lever 12 so that the same is very torsion resistant. An operative contour 38 of the slotted guide 34 is formed in the base circle design of the circumferential contour 16 of the camshaft 18 as a circular path around the center of the third roller element 26 of the drag lever 28 of the drag lever arrangement 8.

A torsion spring element 40 is further provided which has a first end 42 supported in a cylinder housing part 43 and a second end 44 engaging a counter bearing 46 that is rigidly connected with the intermediate lever 12. An axis 53 of the first roller element 14 thereby has a distance to the counter bearing 46 which is greater than a distance of the axis 22 of the second roller element 14 to the counter bearing 46. A force is thereby introduced into the intermediate lever 12 which both presses the second roller element 20 against the slotted guide 34 and the valve stroke adjustment device 10 and presses the first roller element 14 against the camshaft 18.

FIG. 1 shows the gas exchange valve 4 in a closed position, i.e., the valve stroke adjustment device 10 is in contact with the second roller element 20 by the eccentric portion of the circumferential contour 9. The camshaft 18 is in contact with the first roller element 14 by the base circle 19 of the circumferential contour 16, whereby the valve is closed.

Figure 2:
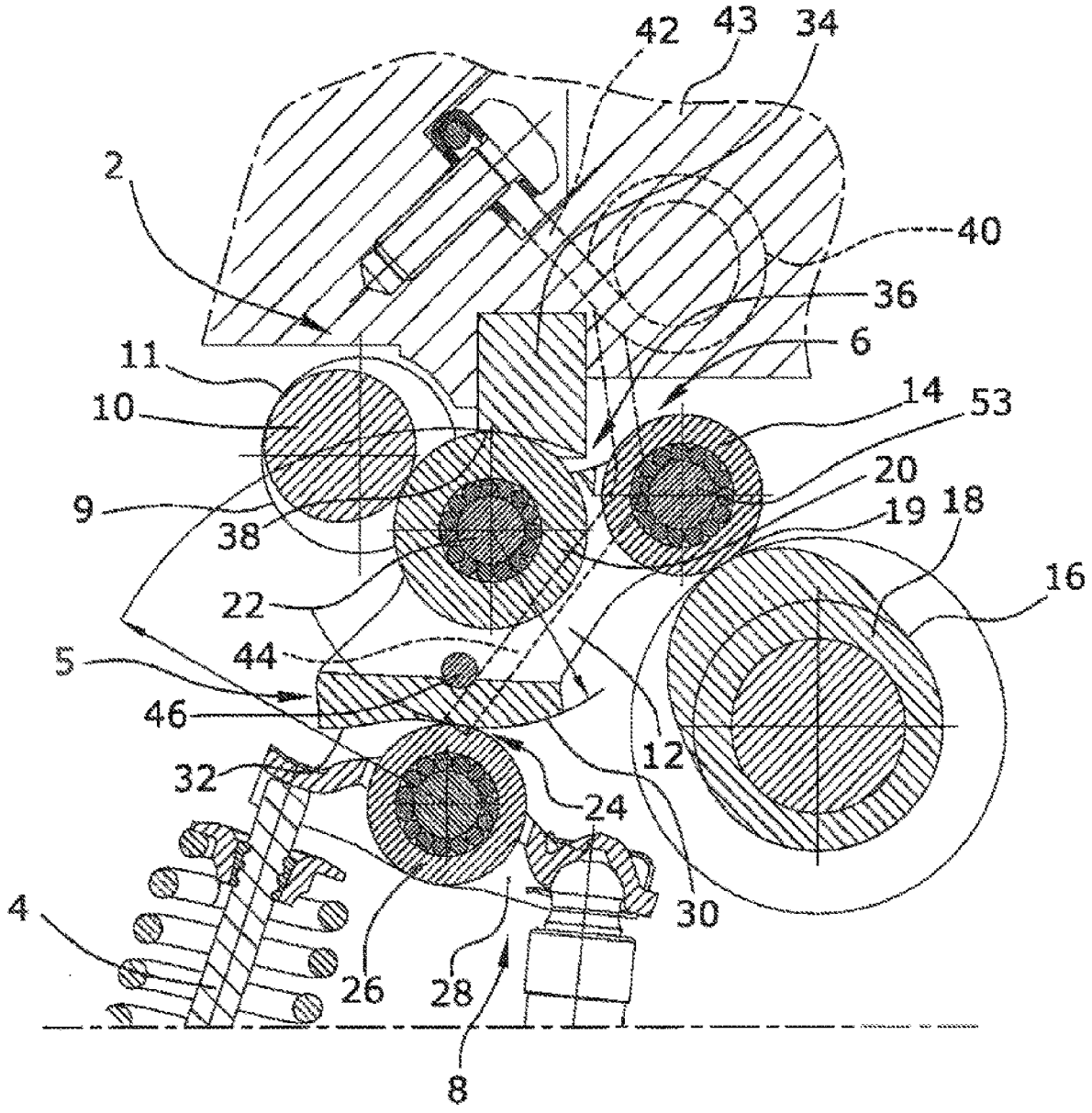
FIG. 2 shows the mechanically controllable valve drive of FIG. 1 with the camshaft rotated through 180° so that the eccentric portion of the circumferential contour is in contact with the first roller element in a maximum position.

FIG. 2 shows the mechanically controllable valve drive 2 of FIG. 1 with the camshaft rotated through 180° so that the eccentric portion of the circumferential contour 16 is in contact with the first roller element 14 in a maximum position. Due to the unchanged position of the valve stroke adjustment device 10, however, the gas exchange valve 4 still remains closed. Only the portion of the partial region 30 of the working curve 24 has shifted with respect to the third roller element 26.

Figure 3:
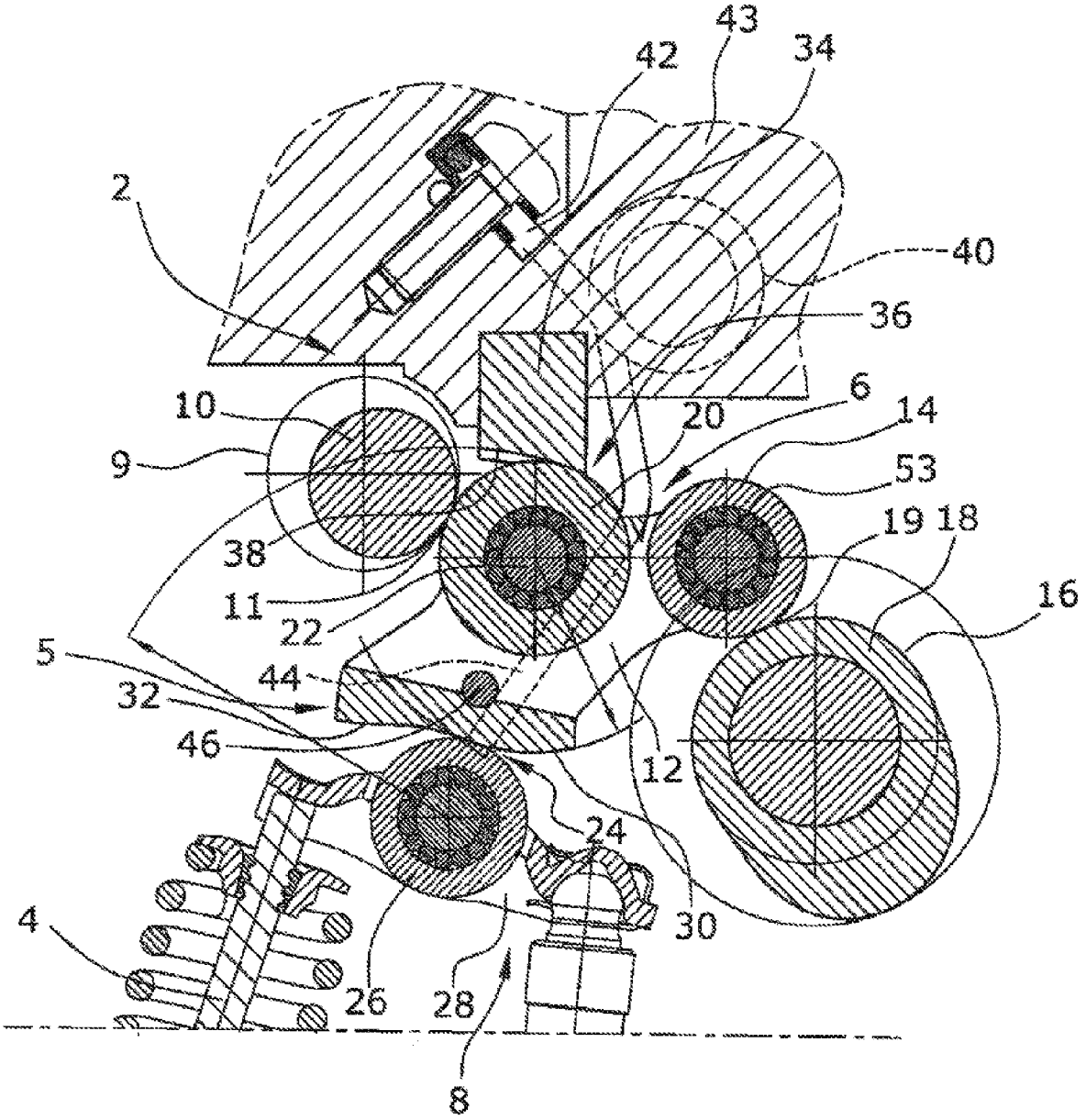
FIG. 3 shows the valve drive with the valve stroke adjustment device in contact with the second roller element by the base circle of the circumferential contour and, consequently, deflecting the roller element as far as possible to the right.

FIG. 3 shows the valve drive 2 with the valve stroke adjustment device 10 in contact with the second roller element 20 by the base circle 11 of the circumferential contour 9 and, consequently, deflecting the roller element 20 as far to the right as possible. Due to the fact that in this case the camshaft 18 contacts the first roller element 14 only by its base circle 19, the gas exchange valve still remains in the closed position.

Figure 4:
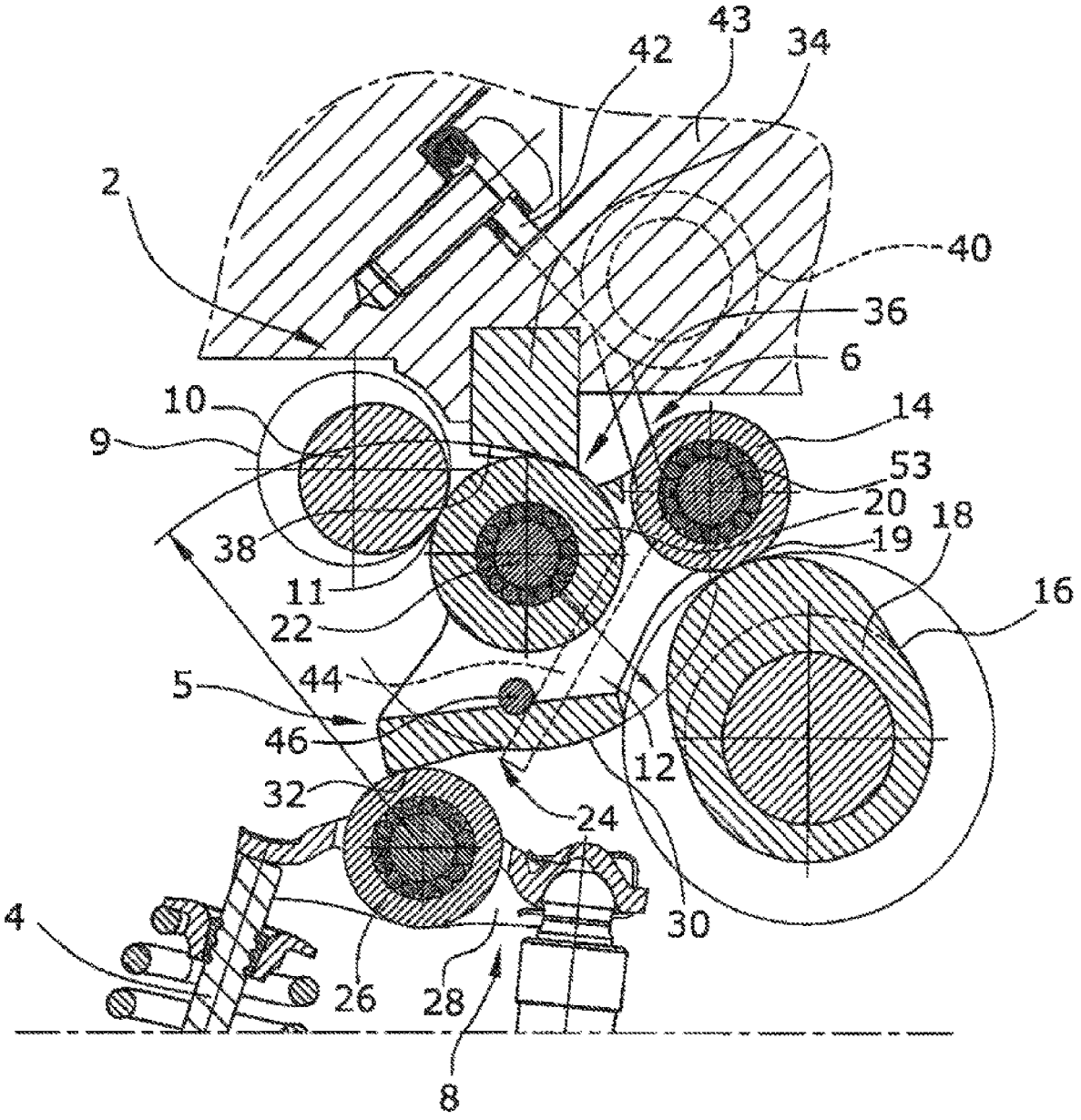
FIG. 4 shows the maximum stroke of the gas exchange valve, wherein the valve stroke adjustment device contacts the second roller element by the basic circle of the circumferential contour and the camshaft contacts the first roller element by the eccentric portion.

FIG. 4 illustrates the maximum stroke of the gas exchange valve 4, wherein the valve stroke adjustment device 10 contacts the second roller element 20 by the base circle 11 of the circumferential contour 9 and the camshaft 18 contacts the first roller element 14 by the eccentric portion of the circumferential contour 16. The working curve 24 now contacts the third roller element 26 by the second (outermost) partial region 32 and thereby causes a maximum stroke of the gas exchange valve 4.

It should be clear that, between the extreme positions shown, a great number of intermediate positions are possible that entail a change not only of the valve stroke and the opening period, but also of the phase of the valve opening relative to the cam angle and thus to the crank angle.

The present invention is not limited to embodiments described herein; reference should be had to the appended claims.

What is claimed is:

1. A mechanically controllable valve drive comprising:

a gas exchange valve;

a camshaft comprising a circumferential contour;

a valve stroke adjusting device;

a cylinder housing portion;

a transfer arrangement paired with the gas exchange valve, the transfer arrangement comprising an intermediate lever arrangement and a drag lever arrangement, wherein, the drag lever arrangement comprises a drag lever, and the intermediate lever arrangement comprises, a first roller element comprising a first roller element axis, the first roller element being configured to be operatively connected to the circumferential contour of the camshaft, and an intermediate lever comprising a working curve and a second roller element, the working curve being configured to be operatively connected to the drag lever of the drag lever arrangement, and the second roller element being rotatably mounted on a second roller element axis so as to directly contact the valve stroke adjusting device such that different valve stroke positions are set;

a spring configured to engage the intermediate lever arrangement;

a counter bearing rigidly connected with the intermediate lever; and a guide configured to engage the intermediate lever arrangement, the guide consisting of a slotted guide which is engaged by the second roller element, wherein, the working curve of the intermediate lever is essentially formed by a first partial region formed as a circular path about a center of the second roller element axis, and a second partial region formed as a continuous lobe curve, the spring is a torsion spring element comprising a first end and a second end, the first end being configured to rest on the cylinder housing portion, and the second end being configured to act on the counter bearing which is rigidly connected with the intermediate lever, the first roller element axis has a distance to the counter bearing which is greater than a distance of the second roller element axis to the counter bearing such that a force is introduced into the intermediate lever which presses the second roller element against the slotted guide and presses the first roller element against the camshaft, the drag lever comprises a third roller element, the slotted guide comprises an effective contour which is formed as a circular path, and a center of the third roller element is a center of the circular path of the slotted guide.

2. The mechanically controllable valve drive as recited in claim 1, wherein the second roller element axis is rigidly connected with the intermediate lever.

* * * * *